US007757435B1

(12) United States Patent
Boskofsky

(10) Patent No.: US 7,757,435 B1
(45) Date of Patent: Jul. 20, 2010

(54) CHRISTMAS TREE WATERING ORNAMENT

(76) Inventor: Kenny Boskofsky, 14515 31st Ave. North East St., Shoreline, WA (US) 98155

( * ) Notice: Subject to any disclaimer, the term of this patent is extended or adjusted under 35 U.S.C. 154(b) by 0 days.

(21) Appl. No.: 12/313,972

(22) Filed: Nov. 26, 2008

(51) Int. Cl.
*A47G 33/08* (2006.01)

(52) U.S. Cl. ..... 47/40.5

(58) Field of Classification Search ..... 47/40.5; D8/1

See application file for complete search history.

(56) References Cited

U.S. PATENT DOCUMENTS

| | | | | | |
|---|---|---|---|---|---|
| 5,054,236 | A | | 10/1991 | Sands | |
| 5,349,997 | A | | 9/1994 | Rial | |
| D353,186 | S | * | 12/1994 | Browning | D8/1 |
| 5,410,839 | A | | 5/1995 | Granger | |
| 5,473,838 | A | | 12/1995 | Denbigh | |
| 5,513,677 | A | * | 5/1996 | McCurry | 141/1 |
| D373,939 | S | | 9/1996 | Swerdlick et al. | |
| 5,661,926 | A | | 9/1997 | Granger | |
| 5,791,083 | A | * | 8/1998 | Giangrossi | 47/40.5 |
| D417,596 | S | | 12/1999 | Crowder | |
| 6,073,390 | A | * | 6/2000 | Baudier | 47/40.5 |
| 6,082,043 | A | | 7/2000 | Andrews | |
| D436,006 | S | | 1/2001 | DeMarino | |
| 6,347,479 | B1 | | 2/2002 | Greenberg et al. | |
| D483,234 | S | | 12/2003 | Hansen | |
| 2005/0204617 | A1 | * | 9/2005 | Sowers | 47/40.5 |

* cited by examiner

*Primary Examiner*—Francis T Palo
(74) *Attorney, Agent, or Firm*—Montgomery Patent and Design; Robert C. Montgomery; Joseph T. Yaksich

(57) ABSTRACT

A decorative Christmas tree ornament which functions as a funnel system to aid in the watering of the tree is herein disclosed. The ornament comprises a flip-open lid, thus exposing an interior reservoir. The ornament itself takes the form of a common Christmas icon such as a snowman, an angel, a bell, a gingerbread man, a globe or the like. The bottom of the reservoir is connected to a section of tubing approximately four (4) to five (5) feet long. The tubing is routed along the branch and down the trunk where it empties into a conventional Christmas tree stand supplied with a water basin. The tubing and ornament are held in place with a plurality of clips. Thus, to water the tree, one simply opens the ornament, pours in a quantity of water and walks away. The system is viewed as being particularly useful for trees that are difficult to reach, or for people who have difficulty in bending over, kneeling or crawling under a Christmas tree.

15 Claims, 4 Drawing Sheets

CHRISTMAS TREE WATERING ORNAMENT

RELATED APPLICATIONS

The present invention was first described in a notarized Official Record of Invention on Jan. 11, 2008, that is on file at the offices of Montgomery Patent and Design, LLC, the entire disclosures of which are incorporated herein by reference.

FIELD OF THE INVENTION

The present invention relates generally to a Christmas tree watering ornament and, more particularly, to said watering ornament comprising an interior reservoir connected to a section of tubing approximately four (4) to five (5) feet long routed along a tree branch and down a tree trunk where it empties into a conventional Christmas tree stand supplied with a water basin, thereby allowing a user to water the tree simply by opening the ornament, pouring in a quantity of water, and allowing the water to drain into the water basin.

BACKGROUND OF THE INVENTION

It is prevalent for people to bring evergreen trees into their homes for decoration as Christmas trees during the holiday season. These trees require maintenance and a constant water supply to keep from drying out. After a few days with no water, the tree will begin to look lifeless, dry out, and lose its green color. Any water provided after that does little or no good with respects to reviving it. This creates a hazardous condition in that the tree has now become a fire hazard. Any spark, flame or amount of high heat will turn it into a blazing inferno in seconds. A common cause of infrequent watering is that it is somewhat difficult to do, as it requires bending over, kneeling down, crawling and the like, which is an inconvenience for many, particularly those who are elderly or disabled. Accordingly, there is a need for a means by which Christmas trees can be ensured an adequate amount of water that is easily replenished without the difficulties as described above. The development of the invention described herein fulfills this need.

There have been attempts in the past to invent ornaments that water Christmas trees. U.S. Pat. No. D 483,234 issued to Hansen discloses a tree watering ornament that appears to be attachable to a tree and has tubing. Unfortunately, this design patent does not appear to be similar in appearance to the disclosed invention, nor does it appear to comprise a ball valve and watering system to prevent the flow of water from the reservoir, nor does it appear to comprise a self closing lid.

U.S. Pat. No. 6,347,479 issued to Greenberg et al discloses a Christmas tree watering apparatus that appears to be a funnel shaped opening attached to tubing that connects to the tree base reservoir. Unfortunately, this patent does not appear to be a Christmas tree ornament that comprises hanging appendages to be maintained in a tree with a reservoir and tubing that provides a fluid conduit to the tree reservoir.

U.S. Pat. No. D 417,596 issued to DeMarino discloses a Christmas tree watering device that appears to comprise a cane shaped ornament that is connected to tubing. Unfortunately, this design patent does not appear to be similar in appearance to the disclosed system, nor does it appear to comprise a ball valve and watering system to prevent the flow of water from the reservoir nor does it appear to comprise a self closing lid.

U.S. Pat. No. 6,082,043 issued to Andrews discloses a Christmas tree watering device that appears to comprise an ornament with an electrically operated sensor mounted in the tubing to control the flow of water from the reservoir in the ornament. Unfortunately, this patent does not appear to disclose an ornament that is secured to a tree via a pair of hanging appendages, nor does it appear to disclose a ball valve system to control the flow of water from the ornament to the tree base reservoir.

U.S. Pat. No. 6,073,390 issued to Baudier discloses a funnel like structure that is mounted in the branches of a Christmas tree and that provides a fluid conduit to the tree base reservoir. Unfortunately, this patent does not appear to disclose a Christmas tree watering ornament with a ball valve structure to conduct water via tubing to the tree base reservoir.

U.S. Pat. No. 5,661,926 issued to Granger discloses a Christmas tree watering funnel with indicating system. Unfortunately, this patent does not appear to disclose an ornament that is secured to a tree via a pair of hanging appendages, nor does it appear to disclose a ball valve system to control the flow of water from the ornament to the tree base reservoir.

U.S. Pat. No. 5,473,838 issued to Denbigh discloses a Christmas tree watering device that appears to comprise a funnel like structure that is clipped onto a Christmas tree. Unfortunately, this patent does not appear to disclose a Christmas tree ornament with a self closing lid, and a ball valve structure that provides a means of fluid communication between the ornament and the tree base reservoir.

U.S. Pat. No. 5,410,839 issued to Granger discloses a Christmas tree watering funnel with indicating light and float. Unfortunately, this patent does not appear to disclose an ornament that is secured to a tree via a pair of hanging appendages, nor does it appear to disclose a ball valve system to control the flow of water from the ornament to the tree base reservoir.

U.S. Pat. No. 5,349,997 issued to Rial discloses a system for watering inside trees utilizing what appears to be a funnel that is in fluid communication with a base reservoir. Unfortunately, this patent does not appear to disclose a Christmas tree ornament with a self closing lid, and a ball valve structure that provides a means of fluid communication between the ornament and the tree base reservoir.

U.S. Pat. No. D 373,939 issued to Crowder discloses a Christmas tree watering ornament that appears to be an ornament mounted on top of an elongated funnel. Unfortunately, this design patent does not appear to be similar in appearance to the disclosed invention, nor does it appear to comprise a ball valve and watering system to prevent the flow of water from the reservoir, nor does it appear to comprise a self closing lid.

U.S. Pat. No. 5,054,236 issued to Sands discloses what appears to be a funnel like reservoir mounted on a spiral tubing structure. Unfortunately, this patent does not appear to disclose an ornament that is secured to a tree via a pair of hanging appendages, nor does it appear to disclose a ball valve system to control the flow of water from the ornament to the tree base reservoir.

None of the prior art particularly describes a Christmas tree watering ornament comprising an interior reservoir connected to a section of tubing approximately four (4) to five (5) feet long routed along a tree branch and down a tree trunk where it empties into a conventional Christmas tree stand supplied with a water basin, thereby allowing a user to water the tree by opening the ornament and pouring in a quantity of water that the instant system possesses. Accordingly, there exists a need for a means by which Christmas trees can be ensured an adequate amount of water that is easily replenished that operates without the disadvantages as described above.

SUMMARY OF THE INVENTION

In light of the disadvantages as described above in the prior art, it is apparent that there is a need for a system and method for a Christmas tree watering system which functions as a funnel system to aid in watering of a tree and comprises an ornament assembly with a flip-open cap exposing an interior reservoir.

An object of the Christmas tree watering system is provided in a variety of decorative ornament bodies comprising various exterior shapes such as a snowman, an angel, a bell, a gingerbread man, or other common seasonal icons.

Another object of the Christmas tree watering system provides various external colors, patterns, and textures, as well as indicia depicting alphanumeric characters, names, logos, cartoon characters, and the like, based upon a user's preference.

A further object of the Christmas tree watering system provides ornament assemblies that may be acquired individually or as a set of two (2) or more having matching or different ornament bodies, colors, indicia, and the like.

Still another object of the Christmas tree watering system is a tube connector assembly that is attached to and detached from the drain aperture allowing a user to manually detach a particular ornament assembly from the system and replace it with another ornament as desired without spilling or loss of water.

Still a further object of the Christmas tree watering system is that to use the device and water the tree, a user simply opens the fill cap, and pours in a quantity of water.

Another object of the Christmas tree watering system provides such a system that is particularly useful for trees that are difficult to reach, or for people who have difficulty in bending over, kneeling or crawling under a Christmas tree.

An aspect of the Christmas tree watering system comprises an ornament assembly, a tube connector assembly, a reservoir, a length of tubing, a plurality of clips, and a pair of hangers.

Another aspect of the Christmas tree watering system comprises an ornament assembly that provides a convenient water receiving and delivering means to a tree via a length of tubing being routed along tree branches and a said trunk portion via a plurality of clips. The ornament assembly provides an attachment means to the tree branches by a pair of hangers comprising common formable metal wires having hooked end portions enabling sturdy configurable attachment to adjacent branches of the tree. The ornament assembly further comprises a fill cap and a pair of hanging appendages.

Still another aspect of the Christmas tree watering system comprises a reservoir connected to a section of tubing approximately four (4) to eight (8) feet long. The tubing is routed along a tree branch and down a trunk portion where it empties into a conventional Christmas tree stand reservoir. The reservoir further comprises an automatic valve allowing a particular ornament to be disconnected from the tubing and replaced with a different ornament without leakage.

Yet another aspect of the Christmas tree watering system comprises an ornament assembly comprising a spring-loaded valving means to a water supply within the reservoir comprising a ball valve, a first spring, a spring housing, and an "O"-ring groove. The ornament assembly is removably attached to the tube connector assembly and attached tubing portion by a drain aperture located along a bottom surface of the ornament assembly allowing detachment and installation of a different ornament assembly.

A further aspect of the Christmas tree watering ornament comprises hanging appendages comprising inverted "U"-shaped closures providing the ornament assembly with two (2) points of support, stabilizing said ornament, and providing a non-rotating means to the ornament assembly allowing a user to hang the ornament assembly in an easily accessible outward facing direction.

Another aspect of the Christmas tree watering system comprises clips that hold the tubing and ornament in place. The clips comprise common easily installed fastening devices such as tie-wraps, hook-and-loop strapping, and the like.

Still a further aspect of the Christmas tree watering system comprises a tube connector assembly comprising a molded plastic conduit fitting, a rubber "O"-ring, a plurality of flow apertures, and an integrally molded aesthetically-shaped flange. The tube connector assembly and ball valve work in conjunction with one another to provide effective control of a water flow from the reservoir to the tubing.

Yet another aspect of the Christmas tree watering ornament is a spherical ball valve that during use is contacted and lifted from its seat by the inserted conduit fitting portion enabling a water flow to commence from the reservoir and enter the tube connector assembly via a plurality of flow apertures. Said water flow proceeds through the tubing and subsequently to the stand/reservoir until such time as the reservoir becomes empty or until the ornament assembly is manually disconnected from the tube connector assembly.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
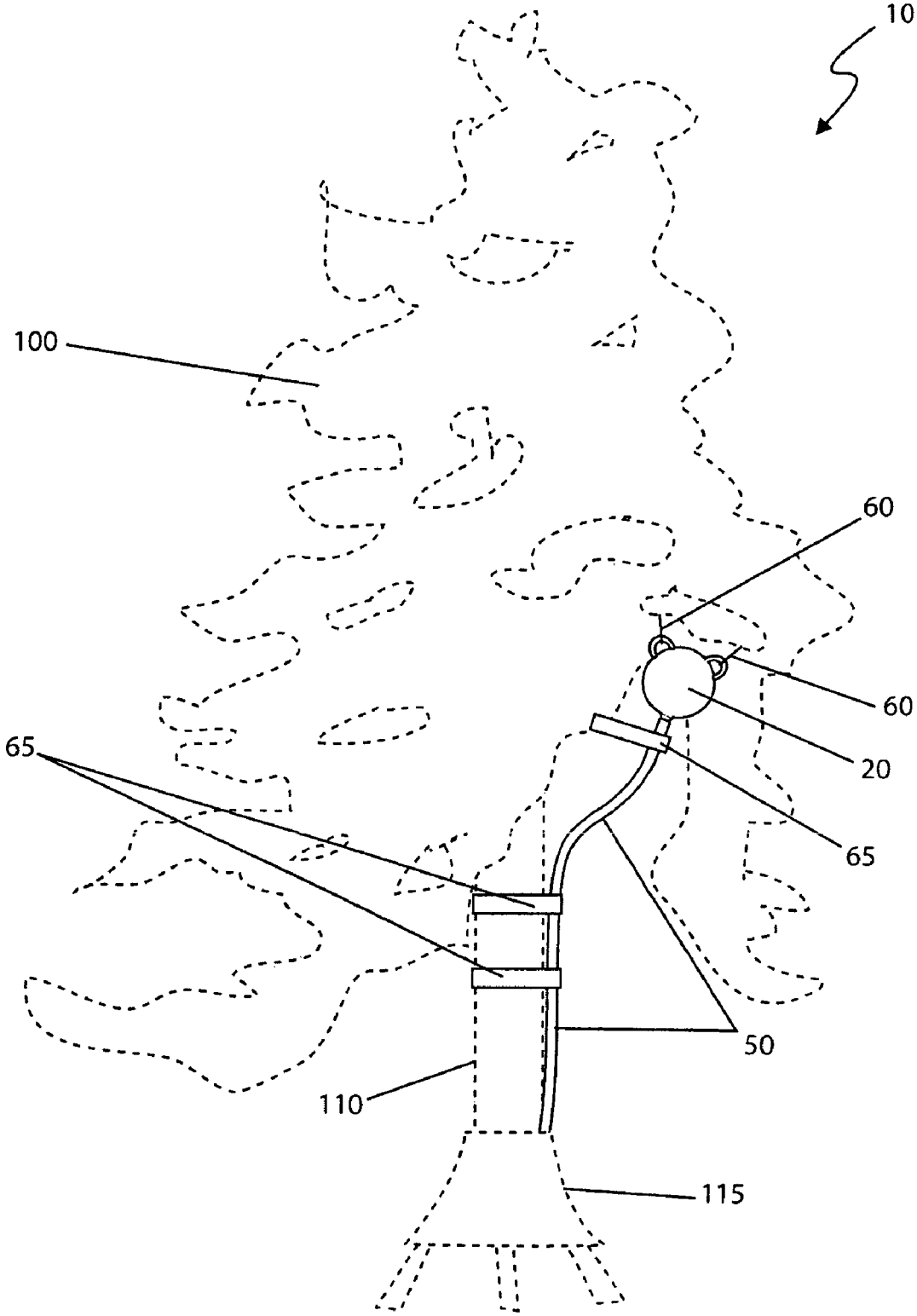
FIG. 1 is an environmental view of a Christmas tree watering ornament 10, according to a preferred embodiment of the present invention.

| DESCRIPTIVE KEY | |
|---|---|
| 10 | Christmas tree watering ornament |
| 20 | ornament assembly |
| 21 | ornament body |
| 22 | indicia |
| 23 | fill cap |
| 24 | drain aperture |
| 25 | hanging appendage |
| 26 | ball valve |
| 27 | first spring |
| 28 | spring housing |
| 29 | "O"-ring groove |
| 30 | reservoir |
| 31 | water |
| 32 | top opening |
| 33 | second spring |
| 40 | tube connector assembly |
| 41 | conduit fitting |
| 42 | "O"-ring |
| 43 | flow aperture |
| 44 | flange |
| 50 | tubing |
| 60 | hanger |
| 65 | clip |
| 100 | Christmas tree/branch |
| 110 | trunk portion |
| 115 | stand/reservoir |

DETAILED DESCRIPTION OF THE PREFERRED EMBODIMENT

The best mode for carrying out the invention is presented in terms of its preferred embodiment, herein depicted within FIGS. 1 through 4*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system and method for a Christmas tree watering ornament (herein described as the "system") 10, which functions as a funnel system to aid in watering of a tree 100 and comprises an ornament assembly 20 with a flip-open cap 23 exposing an interior reservoir 30. The ornament 20 itself may take on a variety of decorative exterior shapes depicting common Christmas icons. The bottom of the reservoir 30 is connected to a section of tubing 50 approximately four (4) to eight (8) feet long. The tubing 50 is routed along a tree branch 100 and down a trunk portion 110 where it empties into a conventional Christmas tree stand reservoir 115. The tubing 50 and ornament 20 are held in place with a plurality of clips 65 and hangers 60, respectively. Additionally, the reservoir 20 comprises an automatic valve 26 allowing a particular ornament 20 to be disconnected therefrom the tubing 50 and replaced with a different ornament 20 without leakage. To water the tree 100, a user simply opens the fill cap 23, pours in a quantity of water 31 and walks away. The system 10 is viewed as being particularly useful for trees 100 that are difficult to reach, or for people who have difficulty in bending over, kneeling or crawling under a Christmas tree 100.

Referring now to FIG. 1, an environmental view of the system 10, according to the preferred embodiment of the present invention, is disclosed. The system 10 comprises an ornament assembly 20, a length of tubing 50, a plurality of clips 65, and a pair of hangers 60. The ornament assembly 20 provides a convenient water receiving and delivering means thereto a tree 100 via a length of tubing 50 being routed along tree branches 100 and a said trunk portion 110 via a plurality of clips 65. The clips 65 provide common easily installed fastening devices such as tie-wraps, hook-and-loop strapping, and the like. The tubing 50 terminates and is inserted therein a conventional tree stand/reservoir device 115 located at a base of the trunk portion 110. The ornament assembly 20 further provides an attachment means thereto the tree branches 100 via a pair of hangers 60 comprising common formable metal wires having hooked end portions enabling sturdy configurable attachment thereto adjacent branches of the tree 100 in an expected manner.

Figure 2B:
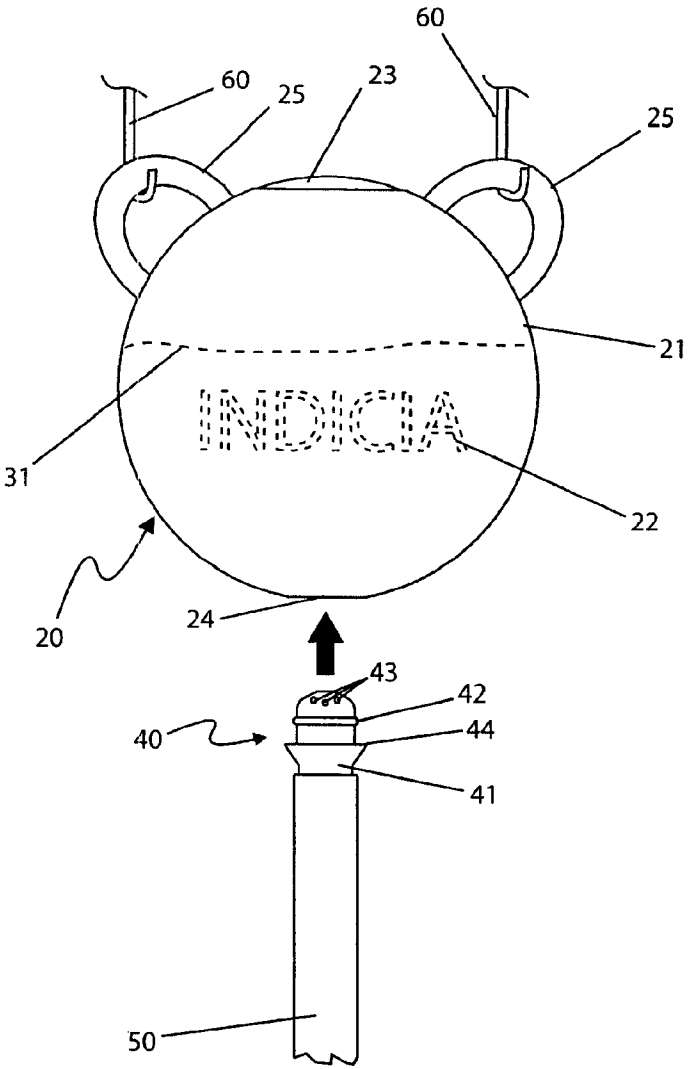
FIG. 2*b* is a close-up view of a an ornament assembly portion 20 of a Christmas tree watering ornament 10 depicting a detached state, according to a preferred embodiment of the present invention.
Figure 2A:
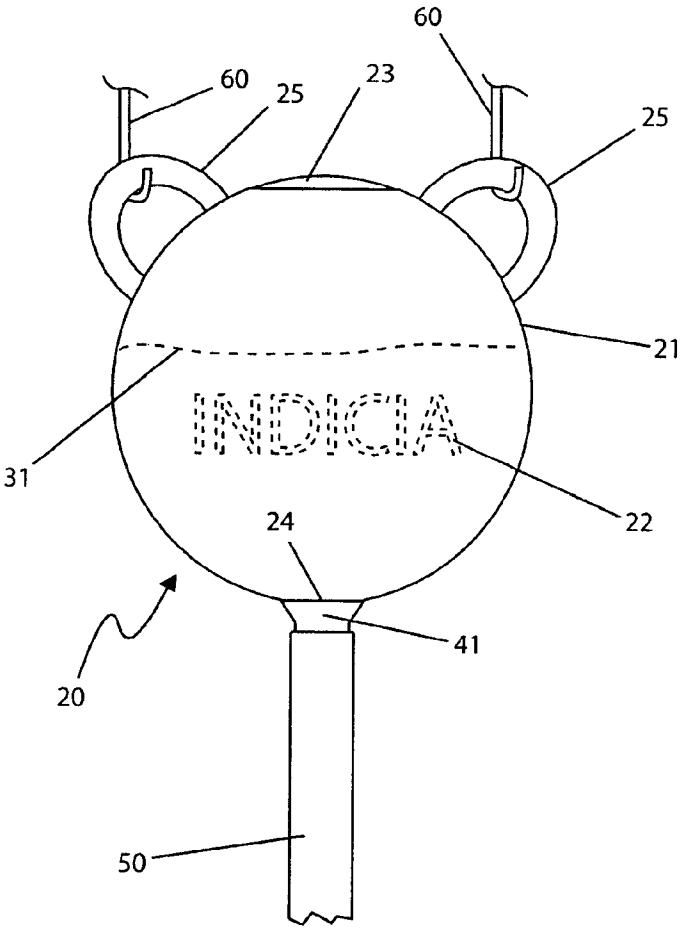
FIG. 2*a* is a close-up view of an ornament assembly portion 20 of a Christmas tree watering ornament 10 depicting an in-use state, according to a preferred embodiment of the present invention.

Referring now to FIGS. 2*a* and 2*b*, close-up views of an ornament assembly portion 20 of the system 10, according to the preferred embodiment of the present invention, are disclosed. The system 10 comprises an ornament assembly 20 and a tube connector assembly 40. The ornament assembly 20 is illustrated here taking the form of a globe; however, the ornament assembly 20 is envisioned to be introduced having a variety of decorative ornament bodies 21 comprising various exterior shapes such as a snowman, an angel, a bell, a gingerbread man, or other common seasonal icons. Furthermore, the ornament assembly 20 may provide various external colors, patterns, and textures, as well as indicia 22 depicting alphanumeric characters, names, logos, cartoon characters, and the like, based upon a user's preference. It is envisioned that ornament assemblies 20 may be purchased individually or as a set of two (2) or more having matching or different ornament bodies 21, colors, indicia, and the like. The ornament assembly 20 further comprises a fill cap 23 and a pair of hanging appendages 25. The fill cap 23 provides a spring-loaded inward hinging door for convenient opening and receiving of water 31 therefrom a container (see FIGS. 4*a* and 4*b*). The hanging appendages 25 are located along an upper surface being adjacent thereto opposing edges of the fill cap 23 providing a convenient loop-shaped fastening means with which to secure the ornament assembly 20 therefrom adjacent branches via the aforementioned hangers 60. The hanging appendages 25 comprise inverted "U"-shaped closures providing the ornament assembly 20 two (2) points of support, thereby stabilizing said ornament 20 such as when water 31 is being added therein. The hanging appendages 25 also provide a non-rotating means thereto the ornament assembly 20 allowing a user to hang the ornament assembly 20 in an easily accessible outward facing direction. The ornament assembly 20 is removably attached thereto the tube connector assembly 40 and attached tubing portion 50 via a drain aperture 24 located along a bottom surface of the ornament assembly 20 allowing detachment and installation of a different ornament assembly 20 as illustrated in FIG. 2*b*.

Figure 3B:
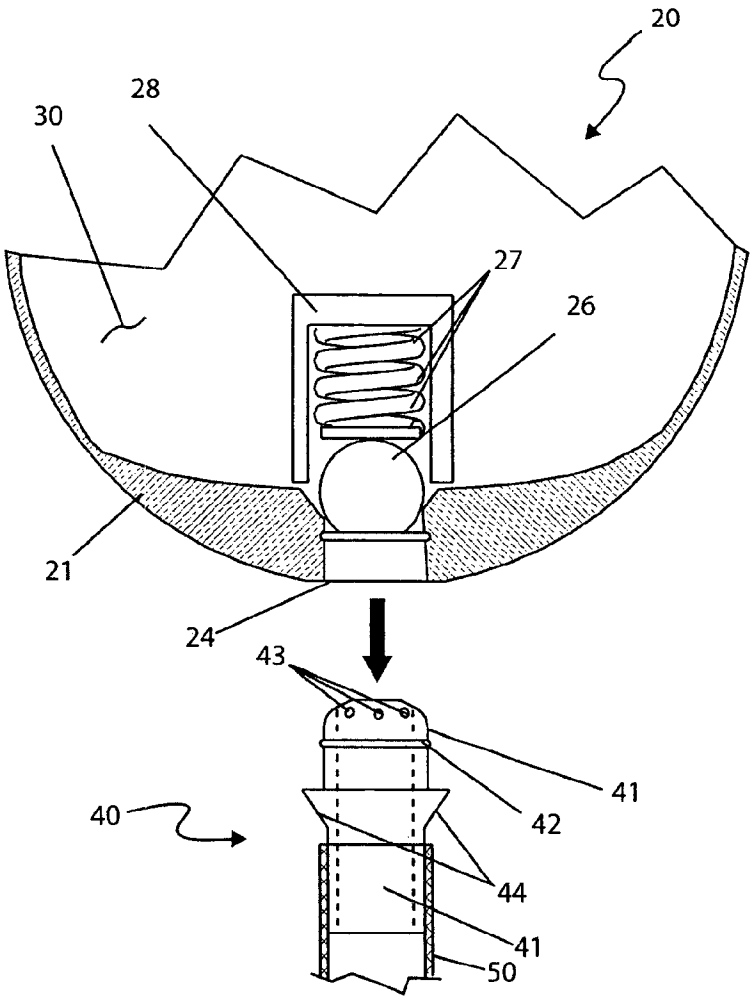
FIG. 3*b* is a cut-away view of a ball valve portion 26 of a Christmas tree watering ornament 10 depicting a water 31 stoppage state, according to a preferred embodiment of the present invention.
Figure 3A:
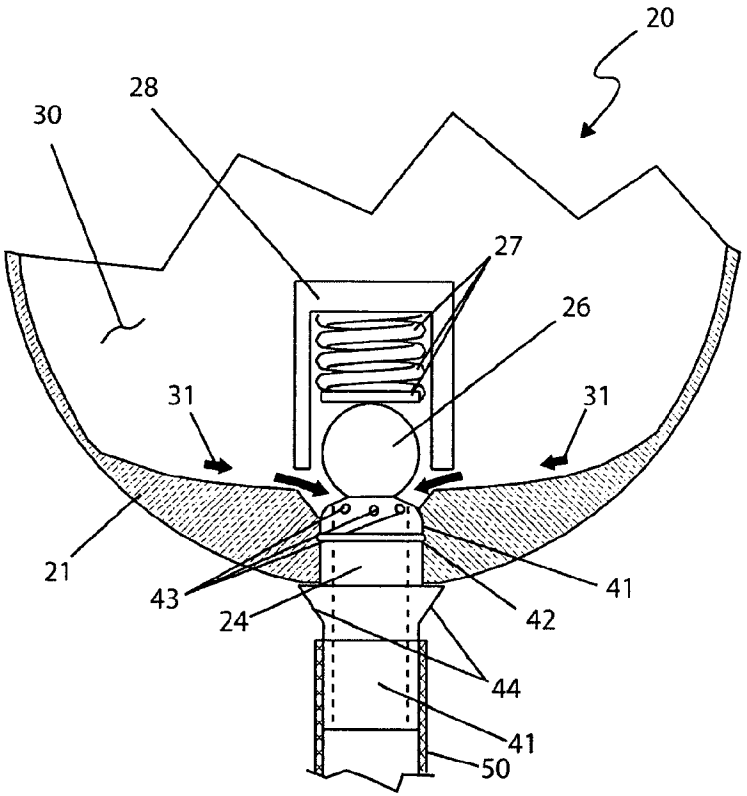
FIG. 3*a* is a cut-away view of a ball valve portion 26 of a Christmas tree watering ornament 10 depicting a water flowing state, according to a preferred embodiment of the present invention.

Referring now to FIGS. 3*a* and 3*b*, cut-away views of a ball valve portion 26 of the system 10, according to a preferred embodiment of the present invention, are disclosed. The tube connector assembly 40 and ball valve 26 work in conjunction therewith one another to provide effective control of a water flow 31 therefrom the reservoir 30 thereinto the tubing portion 50. During use the tube connector assembly 40 is attached thereto and detached therefrom the drain aperture 24 allowing a user to manually detach a particular ornament assembly 20 therefrom the system 10 and replace it with another ornament 20 as desired without spilling or loss of water 31. The ornament assembly 20 provides a spring-loaded valving means thereto a water supply 31 therewithin the reservoir 30 comprising a ball valve 26, a first spring 27, a spring housing 28, and an "O"-ring groove 29. The integrally molded spring housing 28 is located along a bottom interior surface of the ornament body 21 and is positioned directly above the drain aperture 24. The spring housing 28 comprises a hollow cylindrical shape which vertically guides the included rubber ball valve 26 and metal actuating first spring 27. The tube connector assembly 40 provides a sealed fluid conduit means thereto said water 31 as it enters the tubing portion 50. The tube connector assembly 40 comprises a molded plastic conduit fitting 41, a rubber "O"-ring 42, a plurality of flow apertures 43, and an integrally molded aesthetically-shaped flange 44. When the tube connector assembly 40 is inserted therein the drain aperture 24, the "O"-ring 42 provides a sealing means thereto the ornament assembly 20 being sealingly seated therein a corresponding annular "O"-ring groove 29 located within the cylindrically-shaped drain aperture 24 at an intermediate position. During normal use, the spherical ball valve 26 is contacted and lifted therefrom its seat by the inserted conduit fitting portion 41 as illustrated in FIG. 3*a*, thereby enabling a water flow 31 to commence therefrom the reservoir 30 and enter the tube connector assembly 40 via a plurality of flow apertures 43 located along an upper surface of the conduit fitting 41. Said water flow 31 proceeds therethrough the tubing 50 and subsequently to the stand/reservoir 115 until such time as the reservoir 30 becomes empty or until the ornament assembly 20 is manually disconnected therefrom the tube connector assembly 40. Upon disconnection of the ornament assembly 20 as shown in FIG. 3*b*, the ball valve 26 descends thereto its seat along the upper opening of the drain aperture 24 stopping the water flow 31. The ball valve 26 is held against the seat via a constant downward force as applied thereto a top surface of said ball valve 26 therefrom the first spring 27.

Figure 4B:
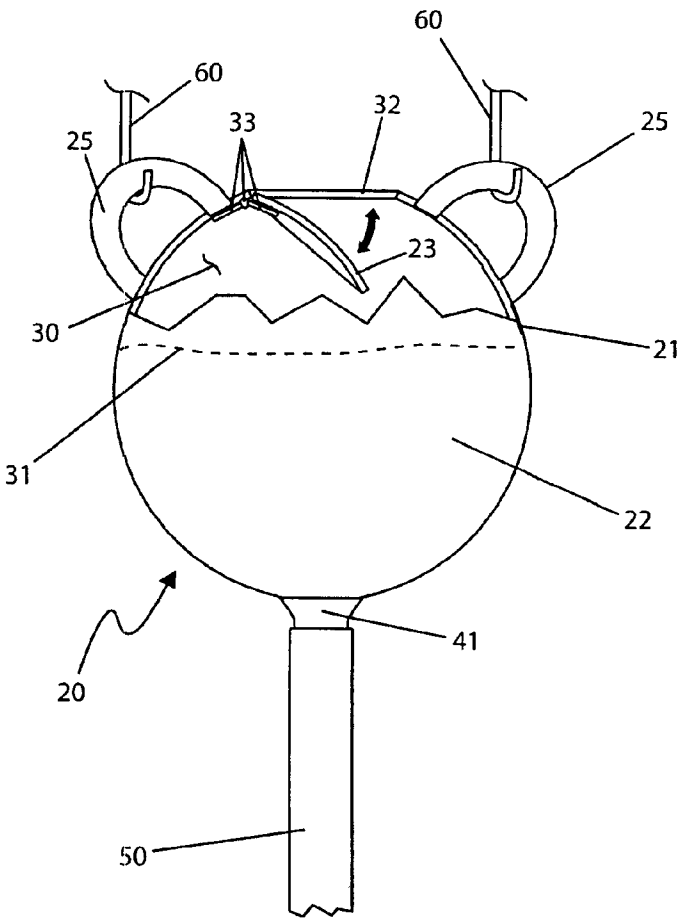
FIG. 4*a* is a cut-away view of a fill cap portion 23 of the ornament assembly 20 depicting a closed state, according to a preferred embodiment of the present invention; and, FIG. 4*b* is a cut-away view of a fill cap portion 23 of the ornament assembly 20 depicting an open state, according to a preferred embodiment of the present invention.
Figure 4A:
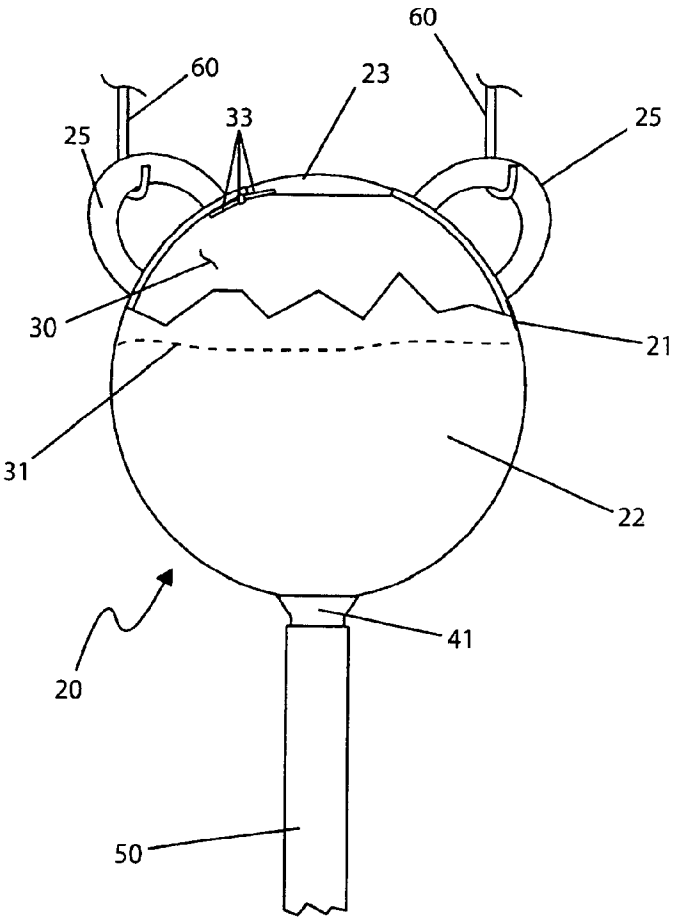

Referring now to FIGS. 4*a* and 4*b*, cut-away views of a fill cap portion 23 of the ornament assembly 20 depicting closed and open states, according to a preferred embodiment of the present invention, are disclosed. The fill cap 23 comprises an injection-molded plastic element envisioned to discreetly conform thereto an upper outer surface of the ornament body 21 by matching curvature and/or particular contours pertaining thereto said ornament body 21. The fill cap 23 comprises a preferably round or elliptical shape; however, the fill cap shape 23 is to be determined by that of the ornament body 21 as previously described. The fill cap 23 provides convenient access thereto the reservoir 30 for a purpose of adding water 31 thereinto. The fill cap 23 comprises an inwardly hinging spring-loaded device being automatically closed upwardly against a top inner surface of the ornament body 21 via an internal torsion-type second spring 33. The ornament assembly 20 comprises integrally molded features along upper interior surfaces being adjacent thereto the top opening 32 forming an attachment means thereto the fill cap 23 and integral second spring 33. In use, a user simply presses downwardly thereupon the fill cap portion 23 which pivots inwardly providing a suitable opening in which to pour water 31 therefrom a bottle or container to obtain a desired fluid level therein the stand/reservoir 115 in an expected manner. Releasing the fill cap 23 allows automatic closure thereof.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of utilizing the system 10 may be achieved by performing the following steps: erecting a Christmas tree 100 equipped therewith a conventional stand/reservoir 115 in a normal fashion upon a floor surface; inserting a lower end portion of the tubing 50 therein the stand/reservoir 115; routing remaining tubing 50 along a trunk portion 110; fastening the tubing 50 thereto the trunk portion 110 using a plurality of clips 65; routing the remaining tubing 50 along a branch 100 being approximately four (4) or five (5) feet above said floor surface thereto a desired region on which to hang the ornament assembly 20 along an exposed outer surface of the tree 100; affixing said tubing 50 thereto said branch 100 using additional clips 65; hanging and securing the ornament assembly 20 adjacent thereto two (2) locations upon the tree 100 or branches 100 at a upper terminating end portion of the tubing 50 using the pair of wire hangers 60; inserting the tube connecting assembly 40 thereinto the drain aperture portion 24 of the ornament assembly 20; pressing inwardly thereupon the fill cap 23 using one's fingers to expose the inner reservoir 30; pouring a quantity of water 31 thereinto the reservoir 30 as needed to obtain a proper level therein the stand/reservoir 115; releasing the fill cap 23 to restore the appearance of the ornament assembly 20; adding water 31 periodically thereto the reservoir 30 in like manner as needed; replacing the ornament assembly 20 as desired therewith another ornament assembly 20 depicting a different shape or figurine by; manually disconnecting the tube connector assembly 40 therefrom the ornament assembly 20; removing said ornament assembly 20 therefrom the tree 100 by unhooking the hangers 60; hanging and utilizing a new ornament assembly 20 as previously described to supply a water flow 31 thereto the tree 100; and, benefiting from decreased effort and possible injuries associated with adding water 31 to a Christmas tree stand/reservoir 115 while using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A Christmas tree watering system, comprising:

an ornament assembly removably attachable thereto a tree branch by a first attachment means and comprising a reservoir therein, further comprising:

a drain aperture located along a bottom surface of said ornament assembly, thereby allowing a tube connector assembly to removably attach a section of tubing thereto said ornament assembly;

a spring housing located along a bottom interior surface of said ornament assembly directly above said drain aperture;

a spring located therein said spring housing; and, a ball valve mechanically connected therewith said spring located therebetween said spring and said drain aperture;

wherein said spring housing provides a vertical guide means thereto said ball valve and said spring;

wherein said section of tubing is removably attached thereto said bottom surface of said ornament assembly by said tube connector assembly and routed along said tree branch and a trunk portion thereinto a tree stand;

wherein said section of tubing is in fluid communication therewith said reservoir; and, wherein said reservoir is filled with a supply of water creating a flow of water therethrough said section of tubing thereinto said tree stand, thereby assisting a user to water a tree.

2. The system of claim 1, wherein said first attachment means comprises a first hanger and a second hanger located along an upper surface of said ornament assembly.

3. The system of claim 2, wherein said first hanger and said second hanger comprise a metal wire with a hooked end portion.

4. The system of claim 1, wherein said section of tubing is removably attachable thereto said tree branch and said trunk portion by a second attachment means.

5. The system of claim 4, wherein said second attachment means comprises a plurality of clips.

6. The system of claim 5, wherein said plurality of clips each comprise one (1) of the following: a tie-wrap or a hook-and-loop strapping.

7. The system of claim 1, wherein said tube connector assembly further comprises:

a conduit fitting comprising a plurality of flow apertures; and, an "O"-ring providing a sealing means therebetween said ornament assembly and said section of tubing;

wherein said conduit fitting contacts and lifts said ball valve, thereby enabling said flow of water to enter said section of tubing therethrough said plurality of flow apertures.

8. The system of claim 7, wherein said tube connector assembly and said ball valve work together to provide a means to effectively control said flow of water therefrom said reservoir thereinto said section of tubing.

9. The system of claim 7, wherein said ball valve stops said flow of water when said tube connector assembly is removed therefrom said ornament assembly by being pushed over said drain aperture by a downward force supplied by said spring.

10. The system of claim 1, wherein said ornament assembly further comprises a removably attachable fill cap, thereby allowing said reservoir to be filled with said supply of water.

11. The system of claim 1, wherein said ornament assembly is available in a variety of decorative exterior shapes.

12. The system of claim 1, wherein said ornament assembly is available in a variety of sizes, colors, patterns, and textures.

13. The system of claim 1, wherein said ornament assembly is available with a variety of indicia thereon an external surface.

14. The system of claim 1, wherein said section of tubing is approximately four (4) to eight (8) feet long.

15. A method for using a Christmas tree watering system, said method comprising the steps of:

providing said system, comprising:

an ornament assembly comprising a reservoir therein removably attachable thereto a tree branch by a first attachment means, further comprising:

a drain aperture located along a bottom surface of said ornament assembly, thereby allowing a tube connector assembly to removably attach a section of tubing thereto said ornament assembly;

a spring housing located along a bottom interior surface of said ornament assembly directly above said drain aperture;

a spring located therein said spring housing; and, a ball valve mechanically connected therewith said spring located therebetween said spring and said drain aperture;

wherein said spring housing provides a vertical guide means thereto said ball valve and said spring;

wherein said section of tubing is removably attached thereto said bottom surface of said ornament assembly by said tube connector assembly and routed along said tree branch and a trunk portion thereinto a tree stand; and wherein said section of tubing is in fluid communication therewith said reservoir;

erecting a Christmas tree equipped therewith said tree stand in a normal fashion upon a floor surface;

inserting a lower end portion of said section of tubing therein said tree stand;

routing remaining portions of said section of tubing along said trunk portion;

fastening said section of tubing thereto said trunk portion using a plurality of clips;

routing said remaining portions of said section of tubing along said tree branch being approximately four (4) or five (5) feet above said floor surface thereto a desired region on which to hang said ornament assembly along an exposed outer surface of said tree;

affixing said section of tubing thereto said tree branch using a remaining plurality of clips;

hanging and securing said ornament assembly adjacent thereto two (2) locations upon said tree or said tree branches at a upper terminating end portion of said section of tubing using a first hanger and a second hanger;

inserting said tube connecting assembly thereinto a drain aperture of said ornament assembly;

pressing inwardly thereupon a fill cap using one's fingers to expose said reservoir;

pouring a supply of water thereinto said reservoir as needed to obtain a proper level therein said tree stand, wherein said reservoir is filled with said supply of water creating a flow of water therethrough said section of tubing thereinto said tree stand, thereby assisting a user to water a tree;

releasing said fill cap to restore an appearance of said ornament assembly;

adding more of said supply of water periodically thereto said reservoir in like manner as needed;

replacing said ornament assembly as desired therewith another ornament assembly depicting a different shape or figurine by manually disconnecting said tube connector assembly therefrom said ornament assembly;

removing said ornament assembly therefrom said tree by unhooking said first hanger and said second hanger;

hanging and utilizing a new ornament assembly as previously described to supply said flow of water thereto said tree stand; and, benefiting from decreased effort and possible injuries associated with adding water to said tree stand while using said system.

* * * * *